US011987916B2

(12) United States Patent
Noelle et al.

(10) Patent No.: US 11,987,916 B2
(45) Date of Patent: May 21, 2024

(54) APPARATUS AND METHOD FOR PRODUCING NONWOVENS

(71) Applicant: ANDRITZ PERFOJET SAS, Montbonnot-Saint-Martin (FR)

(72) Inventors: Frédéric Noelle, Saint-Nazaire-les-Eymes (FR); Laurent Schmit, Le Versoud (FR); Christophe Muffat-Jeandet, Tresserve (FR)

(73) Assignee: Andritz Perfojet SAS, Montbonnot-Saint-Martin (FR)

( * ) Notice: Subject to any disclaimer, the term of this patent is extended or adjusted under 35 U.S.C. 154(b) by 125 days.

(21) Appl. No.: 17/421,049

(22) PCT Filed: Dec. 31, 2019

(86) PCT No.: PCT/EP2019/087194
§ 371 (c)(1),
(2) Date: Jul. 7, 2021

(87) PCT Pub. No.: WO2020/144084
PCT Pub. Date: Jul. 16, 2020

(65) Prior Publication Data

US 2022/0056624 A1 Feb. 24, 2022

(30) Foreign Application Priority Data

Jan. 8, 2019 (FR) ..... 19 00150

(51) Int. Cl.
*D04H 1/736* (2012.01)
*D01G 15/04* (2006.01)
(Continued)

(52) U.S. Cl.
CPC ..... *D04H 1/736* (2013.01); *D01G 15/04* (2013.01); *D01G 15/36* (2013.01); *D01G 15/46* (2013.01)

(58) Field of Classification Search
CPC ..... D01G 15/04; D01G 15/36; D01G 15/46; D01G 15/50; D01G 15/84; D01G 21/00; D04H 1/736; D04H 1/70
(Continued)

(56) References Cited

U.S. PATENT DOCUMENTS 5,226,214 A * 7/1993 Napolitano ..... D01G 15/02 19/296
5,584,101 A * 12/1996 Brabant ..... D04H 1/74 19/106 R
(Continued)

FOREIGN PATENT DOCUMENTS

EP 1318217 A1 6/2003
EP 1589132 A1 * 10/2005 ..... D01G 15/46
(Continued)

OTHER PUBLICATIONS

Yang, et al. Mechanism and Features of New Type Nonwoven Full-Transfer Output Roll Carding Machine. May 2018. Retrieved from internet: https://www.sohu.com/a/277219185_653799 (Year: 2018).*
(Continued)

*Primary Examiner* — Aiying Zhao
(74) *Attorney, Agent, or Firm* — Renner, Kenner, Greive, Bobak, Taylor & Weber

(57) ABSTRACT

An apparatus is provided for producing nonwovens. The apparatus includes a card drum that is rotatable in a first direction of rotation, a transfer cylinder that is rotatable in a second direction of rotation opposite to the first direction of rotation, at least one doffer, at least one condenser, at least one stripper roll, a first endless conveyor belt, a suction drum and a second endless conveyor belt.

8 Claims, 2 Drawing Sheets

(51) Int. Cl.
*D01G 15/36* (2006.01)
*D01G 15/46* (2006.01)

(58) Field of Classification Search
USPC ..... 19/98, 100, 106 R, 108, 111, 114, 296
See application file for complete search history.

(56) References Cited

U.S. PATENT DOCUMENTS 6,073,313 A * 6/2000 Lasenga ..... D01G 15/04 19/106 R
6,195,844 B1 * 3/2001 Jourde ..... D04H 1/74 19/163
2003/0061686 A1 * 4/2003 Collotte ..... D01G 15/465 19/308
2003/0097734 A1 * 5/2003 Dupont ..... D01G 15/46 19/296
2005/0022343 A1 * 2/2005 Bernhardt ..... D04H 1/74 19/98
2006/0014464 A1 1/2006 Noelle et al.
2007/0000107 A1 * 1/2007 Jeambar ..... D04H 1/492 162/157.1
2007/0173163 A1 7/2007 Noelle et al.
2008/0193790 A1 * 8/2008 Leroy ..... D21F 11/006 28/100
2011/0070791 A1 * 3/2011 Kulkarni ..... D04H 13/00 442/1
2017/0145610 A1 * 5/2017 Kulkarni ..... B32B 5/06
2019/0271102 A1 * 9/2019 Laune ..... D01G 25/00

FOREIGN PATENT DOCUMENTS

FR 2846013 A1 4/2004
WO 0024955 A1 5/2000

OTHER PUBLICATIONS

International Search Report PCT/EP2019/087194 dated Feb. 27, 2020.

* cited by examiner

APPARATUS AND METHOD FOR PRODUCING NONWOVENS

TECHNICAL FIELD

The present invention relates to an apparatus and to a method for producing nonwovens in a drylaid process.

BACKGROUND

Apparatuses for producing nonwovens in a drylaid process generally comprise a section for forming a web or a fleece, said section comprising one or two cards, followed by a section for water-jet consolidation, generally over a plurality of rotary cylinders and a series of conveyors, then a section for extracting water using a high vacuum, most commonly, then a drying section and lastly a rolling-up unit.

These apparatuses for drylaid production are advantageous in that they produce lightweight nonwovens, generally from 20 to 80 g/m$^2$, at high speeds from 150 to 350 m/minute. The nonwovens produced are of a high quality and are economical to produce, but their tensile strength in the machine direction is much greater than the tensile strength in the cross direction. This is because the webs are formed by direct carding. The machine direction/cross direction strength ratios are generally more than 3:1 or even 4:1; in other words, the tensile strength in the machine direction is four times greater than the tensile strength of the same nonwoven in the cross direction.

When nonwovens having very similar strength properties in both the machine direction and the cross direction are desired, it is customary to arrange a crosslapper between the card and the consolidation station. The crosslapper folds in layers and across the card web to impart tensile strength in the cross direction. However, the main disadvantage of this technique is that it is slow and is designed for heavy fleeces, or at the very least for fleeces that are heavier than with direct carding.

To produce lightweight fleeces of 40 to 60 g/m$^2$, for example using a card followed by a crosslapper, it is necessary to keep to small number of folds (from one to three folds) and to draft the fleece at the outlet of the crosslapper using drafting rolls. These two factors (small number of folds and use of a drafting system) are detrimental to the homogeneity of the fleece and of the nonwoven produced. In addition, even with the best possible speed conditions, the production of lightweight nonwovens using a crosslapper is limited to around 180 to 200 kg/h and by metre of production width, and with fine fibres having a titre between 1.3 and 2.2 dtex.

SUMMARY OF THE INVENTION

The present invention provides an apparatus for producing nonwovens in a drylaid process, comprising a card drum rotated in a first direction of rotation and at a first circumferential rotational speed by first driving means, producing a fibre web in the process, characterised in that it comprises, immediately downstream of the drum in the direction in which the fibres travel in the apparatus, a transfer cylinder rotated in a second direction of rotation, opposite to the first direction of rotation, and at a second circumferential rotational speed by second rotation means, the second speed being greater than the first speed, the transfer cylinder having, on the periphery, a lining comprising a plurality of teeth that are angled with respect to the radius of the cylinder and face in the second direction of rotation, and, immediately downstream of the transfer cylinder, a system that comprises, immediately sequentially in the upstream-downstream direction, at least one doffer, at least one condenser, at least one stripper roll, a first endless conveyor belt, a suction drum and a second endless conveyor belt, the suction drum being adjacent to the upper side of the first and second conveyor belts and ensuring the fibres pass from one to the other.

The present invention further provides a method for producing nonwovens, in which the apparatus according to the invention is operated according to the speed ratios according to the invention.

DETAILED DESCRIPTION OF THE INVENTION

Figure 1:
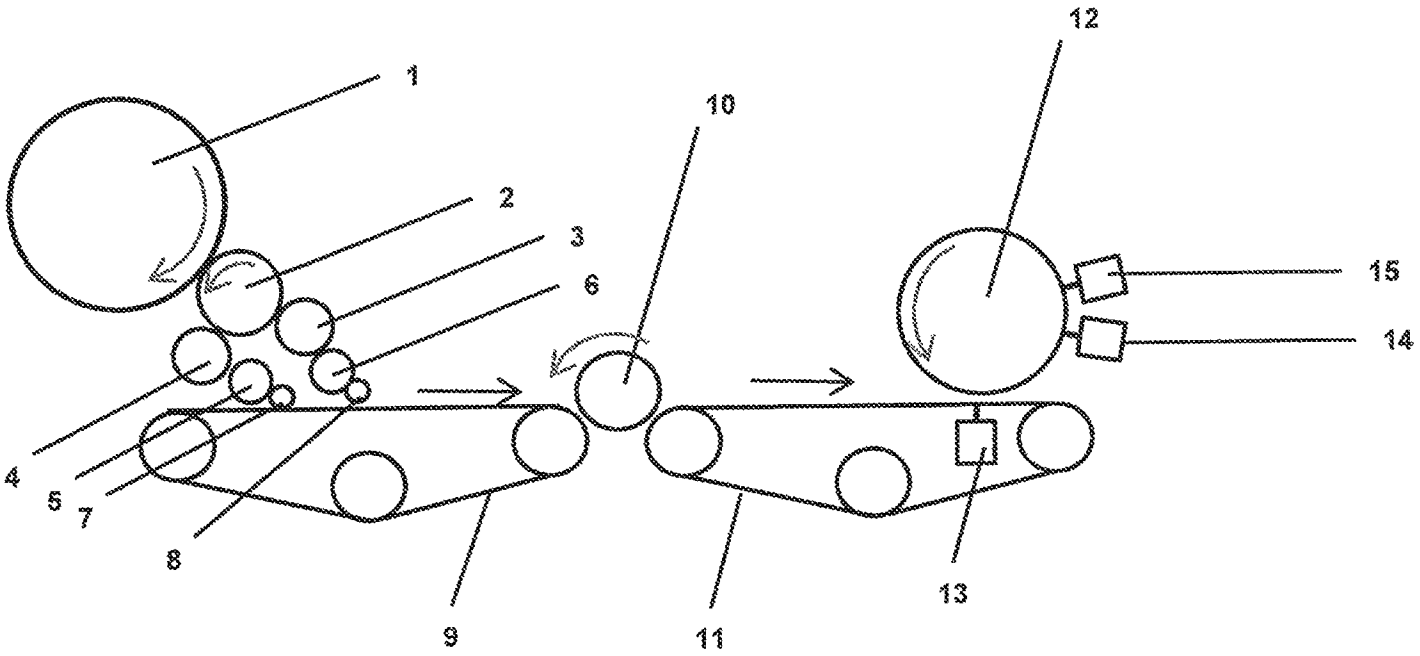
FIG. 1 is a diagram of an apparatus according to the invention.

According to the invention, an apparatus has been developed that makes it possible to produce nonwovens in a drylaid process that even have a basis weight between 40 and 80 g/m$^2$ through direct carding, with high throughputs and machine direction/cross direction strength ratios of less than 2.5:1, less than 2:1, or even less than 1.5:1 and very close to 1.0, and that are well suited to high-quality markets, such as professional cleaning wipes or cosmetic masks, in which the nonwovens should be as lightweight as possible; this is provided that the rotational speeds of the components forming the apparatus are controlled as stipulated according to the invention.

Productivity is increased by 40 to 50% compared with an apparatus of the same width having a crosslapper and drafting system and producing lightweight nonwovens. In addition, the invention requires just one card and no other additional machines such as a lapper or a drafting system, needs much less investment, uses much fewer moving mechanical components (e.g. rolls, belts) and consumes less energy per kilo of product.

The apparatus for producing nonwovens in a drylaid process according to the invention comprises a card drum rotated in a first direction of rotation and at a first circumferential rotational speed by first driving means, producing a fibre web in the process. It is characterised in that it comprises, immediately downstream of the drum in the direction in which the fibres travel in the apparatus, a transfer cylinder rotated in a second direction of rotation, opposite to the first direction of rotation, and at a second circumferential rotational speed by second rotation means, the second speed being greater than the first speed, the transfer cylinder having, on the periphery, a lining comprising a plurality of teeth that are angled with respect to the radius of the cylinder and oriented in the second direction of rotation, and, immediately downstream of the transfer cylinder, a system that comprises, immediately sequentially in the upstream-downstream direction, at least one doffer, at least one condenser, at least one stripper roll, a first endless conveyor belt, a suction drum and a second endless conveyor belt, the suction drum being adjacent to the upper side of the first and second conveyor belts and ensuring the fibres pass from one to the other.

In this specification, "immediately downstream" should be understood to mean either that the component immediately downstream is adjacent to the component immediately upstream, or at least that there are no other rolls or drums between them.

Unexpectedly, this apparatus makes it possible to omit a crosslapper. What is particularly surprising is that the improvement in the isotropy of the nonwoven is apparent not just immediately after the toothed transfer cylinder, but also increasingly beyond it along the entire line.

If an apparatus not having the transfer cylinder is used and the speed ratios are varied according to the invention, in particular as specified in the table below, creases and visual flaws result in the nonwoven, without the machine direction/cross direction strength ratio improving sufficiently at the same time.

Preferably, the ratio of the second speed to the first speed is greater than or equal to 1.6 and even more preferably greater than or equal to 1.7.

When the rotational speed ratios between the various components of the apparatus are, preferably, as follows:

TABLE 1

| | |
|---|---|
| cylinder 2/drum 1 | 1.60 to 1.80 |
| doffers 3 and 4/cylinder 2 | 0.10 to 0.20 |
| condensers 5 and 6/doffers 3 and 4 | 0.35 to 0.55 |
| stripper rolls 7 and 8/condensers 5 and 6 | 1.50 to 1.75 |
| conveyor 9/stripper rolls 8 | 0.95 to 1.10 |
| drum 10/conveyor 9 | 0.70 to 0.90 |
| conveyor 11/drum 10 | 0.70 to 0.90 |
| cylinder 12/conveyor 11 | 0.75 to 1.05 |

The invention also proposes a method for producing nonwovens, in which the apparatus according to the invention is operated according to the speed ratios according to the invention.

It is possible to obtain a nonwoven product based on artificial and/or synthetic fibres, such as viscose, lyocell, polyester or polypropylene, having a weight per square metre between 40 and 80 g/m$^2$ and the fibres of which have a titre between 1.3 and 2.2 dtex and a length between 30 and 50 mm, the machine direction/cross direction tensile strength ratio is from 1.0 to 1.5, the elongation in the machine direction is between 35 and 70% and preferably between 40 and 60%, and the elongation in the cross direction is between 70 and 130% and preferably between 90 and 125%.

The measurements for strength in the longitudinal direction (MD) and in the cross direction (CD) and for weight per m$^2$ are taken in accordance with the ERT standards of the European Disposables And Nonwovens Association (EDANA), as follows:

a) Weight Per Square Metre:

A sample is conditioned for 24 hours and the test is carried out at 23° C. and a relative humidity of 50%. At least three samples having a surface area of at least 50,000 mm$^2$ are cut using a guillotine-type cutting implement.

Each sample is weighed on a laboratory balance having a degree of precision of 0.1% for the weight of the weighed samples.

b) Strength and Elongation in the Longitudinal Direction and the Cross Direction:

A sample is conditioned for 24 hours and the test is carried out at 23° C. and a relative humidity of 50%. A dynamometer comprising one set of stationary jaws and one set of movable jaws that move at a constant speed is used for the test. The dynamometer jaws have a working width of 50 mm. The dynamometer is fitted with a recording instrument for tracking the curve of the pulling force as a function of the elongation. Five 50-mm samples are cut, having a width of approximately 0.5 mm and a length of 250 mm, in both the longitudinal direction and the cross direction of the nonwoven. The samples are tested one by one at a constant pulling speed of 100 mm per minute, with an initial distance between the jaws of 200 mm. The dynamometer records the curve of the pulling force in Newtons as a function of the elongation.

The invention also relates to a method for producing the above nonwoven product, in which the apparatus according to the invention is operated while imposing on its various components the rotational speeds for obtaining the desired ratios.

The diameter of the transfer cylinder is preferably less than that of the card drum. The ratio is, for example, between 0.40 and 0.50. Generally the card drum has a diameter between 900 and 1,500.

The tilt angle of the teeth with respect to the radius can be between 70° and 80°. The radial height of the teeth is advantageously between 0.7 and 1.5 mm. The teeth are distributed uniformly across the entire periphery of the transfer cylinder, the gap between two neighbouring teeth being between 1.3 and 2.3 mm. The width of the teeth at their base is between 0.70 and 1.2 mm. The distance between the card drum and the transfer cylinder is less than 1 mm, preferably being between 0.4 and 0.6 mm.

The side flanks of the teeth can be straight or curved.

The teeth are preferably pointed.

The transfer cylinder and its lining can be made of metal.

The card drum is formed in the same way as the transfer cylinder, having teeth angled by the same angle as the tilt of the teeth of the transfer cylinder in the opposite direction.

The teeth are angled in the direction of rotation.

Preferably, the anisotropy of the nonwoven is reduced further by a suction cylinder adjacent to the upper side of the second conveyor belt.

The apparatus comprises, generally at the end, a consolidation device on the suction cylinder and/or downstream thereof. The consolidation device can be provided by water jets, hot-air jets, calendering or needling, or can be implemented in a hot-air consolidation oven, or the like.

The accompanying drawings, provided solely by way of example, are discussed herein below.

The apparatus in FIG. 1 comprises at least one card drum 1 driven by its own motor, and a transfer cylinder 2 which is rotated by its own motor and unloads all the fibres from the surface of the drum 1. Following said transfer cylinder 2, one or two doffers 3 and 4, driven by their own motor, take the fibres off the surface of the transfer cylinder 2. Next are the condensers 5 and 6 and the stripper rolls 7 and 8, which are driven by their own motor; then comes a transfer to a conveyor belt 9. The apparatus then comprises a suction drum 10 for condensing and transferring, arranged between the conveyor 9 and an input conveyor belt 11 for a water-jet consolidation apparatus. Advantageously, the water-jet consolidation apparatus conforms to that described in European patent no. 1 554 421. It comprises a first water-jet consolidation cylinder 12, which is tangential to the belt 11 and comprises a pre-wetting injector 13 arranged substantially at the point of transfer between the belt 11 and the cylinder 12 and the consolidation injectors 14 and 15. This first consolidation cylinder 12 may be followed by other water-jet consolidation cylinders, in order to impart better strength on the nonwovens thus produced.

The various rotating components of the apparatus are driven by their own motor, which are illustrated in FIG. 1 by the arrows indicating the directions of rotation for the two of them the furthest downstream in the division direction of the card web.

The distance between the drum 10 and the belt 9 and between the belt 11 and the cylinder 12 is between 2 and 15 mm.

Figure 2:
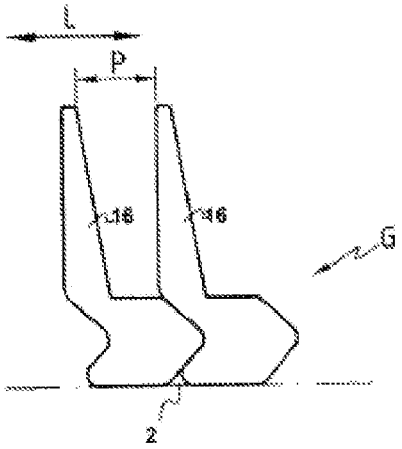
FIGS. 2 and 3 are larger-scale views of the teeth of the lining of the transfer cylinder.
Figure 3:
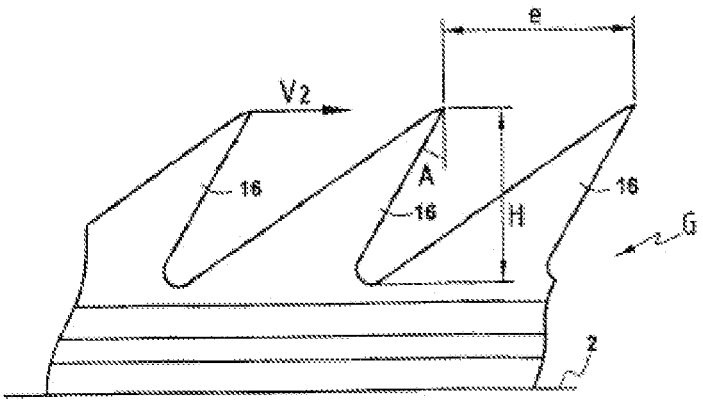

In FIGS. 2 and 3, the transfer cylinder 2 is fitted, on its periphery, with a metal lining G. This lining G is composed of a plurality of teeth 16. In FIG. 2, the double arrow L represents the direction parallel to the longitudinal axis of the transfer cylinder 2, i.e. the direction orthogonal to the plane of FIG. 1. FIG. 3 is a sectional view of the lining of the transfer cylinder 2 in a plane transverse to the longitudinal axis thereof. The teeth 16 of the lining G are aligned in the form of adjacent rows parallel to the longitudinal axis of the transfer cylinder 2. FIG. 2 only shows two adjacent rows of teeth 16. Each tooth 16 of the lining G is angled with respect to the radius of the transfer cylinder 2 at an angle A and faces in the direction of rotation of the cylinder 2 (circumferential speed). The circumferential distance e between two points on two neighbouring teeth is equal to 1.80 mm. The axial length H of a tooth is equal to 1.20 mm.

The following examples illustrate the invention.

Example 1 (Comparative)

A fleece weighing approximately 60 g/m$^2$, composed of 50% polyester fibres of 1.7 dtex measuring 38 mm in length and of 50% viscose fibres of 1.7 dtex measuring 40 mm in length, is produced at a speed of approximately 78 m/min at the cylinder 12.

For this test, the card is a conventional card without a drum 2 and is controlled according to the optimum production settings for producing nonwovens. The speeds of each component are set out in the table further below.

The bonding cylinder 12 is covered with a microperforated sleeve as described in French patent no. 2 734 285. The fleece is first wetted by an injector 13 that projects water jets of a diameter of 140 micrometres at a pressure of 10 bar, the jets being spaced apart from one another by 0.9 mm in two rows. The fleece thus wetted and slightly consolidated is then subjected to the action of a series of two hydraulic injectors 14 and 15 that project water jets of a diameter of 120 micrometres at increasing pressures of 70 bar and 90 bar, the jets being spaced apart from one another by 1.4 mm in two rows.

The bonding cylinder 12 is followed by another bonding cylinder (not shown), which is covered with the same microperforated sleeve as the cylinder 12 and fitted with an injector that projects, on the opposite face to the injectors 14 and 15, water jets of a diameter of 120 micrometres at a pressure of 100 bar.

The nonwoven thus obtained is then transferred to a suction belt connected to a vacuum generator, and then dried at a temperature of 140° C. in a through-air dryer.

A nonwoven weighing approximately 60 g/m$^2$ is obtained. The nonwoven has a uniform appearance.

Example 2 (Comparative)

The conditions of example 1 are repeated using an apparatus according to the invention, which now comprises a cylinder 2, but the apparatus is operated at the speeds indicated in the table further below.

A nonwoven weighing approximately 60 g/m$^2$ is obtained. The nonwoven has a uniform appearance but the MD/CD ratio is poor.

Example 3

The conditions of example 2 are repeated. For this test, the speeds of the various components are modified according to the table further below.

A nonwoven weighing approximately 60 g/m$^2$ is obtained. The nonwoven has a uniform appearance and a satisfactory MD/CD ratio.

Example 4

The conditions of example 2 are repeated. For this test, the speeds of the various components are modified according to the table further below.

A nonwoven weighing approximately 60 g/m$^2$ is obtained. The nonwoven has a uniform appearance and an even better MD/CD ratio than in example 3.

Example 5

The conditions of example 2 are repeated. For this test, the speeds of the various components are modified according to the table further below.

A nonwoven weighing approximately 60 g/m$^2$ is obtained. The nonwoven has a uniform appearance and an even better MD/CD ratio than in example 4.

Example 6

The conditions of example 2 are repeated. For this test, the speeds of the various components are modified according to the table further below.

A nonwoven weighing approximately 60 g/m$^2$ is obtained. The nonwoven has a uniform appearance and an MD/CD ratio of 1.2, which is altogether exceptional and unexpected.

Example 7 (Comparative)

Example 1 is repeated using a conventional card not having a transfer cylinder, while applying the speed ratios in example 5 for the doffers up to the cylinder 12. The nonwoven produced has numerous creases in the transverse direction and is unusable or unsellable.

TABLE 2

| Elements | Units | Example 1 | Example 2 | Example 3 | Example 4 | Example 5 | Example 6 |
|---|---|---|---|---|---|---|---|
| Drum 1 | m/min | 1,300 | 850 | 850 | 850 | 850 | 850 |
| Drum 2 | m/min | 0 | 1,450 | 1,450 | 1,450 | 1,450 | 1,450 |
| Doffer 3 | m/min | 78 | 78 | 96 | 120 | 146 | 177 |
| Doffer 4 | m/min | 77 | 77 | 96 | 120 | 146 | 177 |
| Condenser 5 | m/min | 38 | 38 | 45 | 56 | 68 | 83 |

TABLE 2-continued

| Elements | Units | Example 1 | Example 2 | Example 3 | Example 4 | Example 5 | Example 6 |
|---|---|---|---|---|---|---|---|
| Condenser 6 | m/min | 38 | 38 | 45 | 56 | 68 | 83 |
| Stripper roll 7 | m/min | 74 | 74 | 74 | 92 | 112 | 136 |
| Stripper roll 8 | m/min | 74 | 74 | 74 | 92 | 112 | 136 |
| Conveyor 9 | m/min | 74 | 74 | 74 | 93 | 113 | 137 |
| Drum 10 | m/min | 75 | 75 | 75 | 74 | 90 | 109 |
| Conveyor 11 | m/min | 75 | 75 | 75 | 74 | 73 | 89 |
| Cylinder 12 | m/min | 79 | 79 | 79 | 78 | 77 | 77 |
| Basis weight | $g/m^2$ | 60.5 | 60.5 | 60.0 | 60.2 | 60.0 | 60.4 |
| MD tensile strength | N/50 mm | 110.0 | 103.0 | 101.3 | 86.2 | 79.8 | 62.9 |
| CD tensile strength | N/50 mm | 26.2 | 36.3 | 41.5 | 44.8 | 52.0 | 54.3 |
| MD elongation | % | 28.9 | 36.5 | 42.8 | 51.2 | 52.8 | 59.0 |
| CD elongation | % | 135.0 | 125.7 | 124.8 | 110.0 | 108.0 | 99.8 |
| MD/CD ratio | N/A | 4.2 | 2.8 | 2.4 | 1.9 | 1.5 | 1.2 |

MD stands for machine direction; CD stands for cross direction.

The unit m/min is the unit for the circumferential speed of the various components forming the apparatus.

The invention claimed is:

1. A method for producing nonwovens in a drylaid process in which fibres travel in a travelling direction, in an apparatus comprising:

a card drum (1) that is rotatable in a first direction of rotation and at a first circumferential rotational speed by a first driving means, to thereby produce a fibre web in the process, wherein the apparatus further comprises, immediately downstream of the card drum (1) in the direction in which the fibres travel in the apparatus, a transfer cylinder (2) that is rotatable in a second direction of rotation, opposite to the first direction of rotation, and at a second circumferential rotational speed by a second rotation means, the second circumferential rotational speed being greater than the first circumferential rotational speed, the transfer cylinder (2) having, on a periphery, a covering (G) comprising a plurality of teeth (16) that are angled with respect to a radius of the transfer cylinder (2) and are oriented in the second direction of rotation, and, the apparatus further comprising immediately downstream of the transfer cylinder (2), a system that comprises, immediately sequentially in a travelling direction, at least one doffer (3, 4), at least one condenser (5, 6), at least one stripper roll (7, 8), a first endless conveyor belt (9) with an upper side, a suction drum (10), and a second endless conveyor belt (11) with an upper side, the suction drum (10) being adjacent to the upper side of each of the first and second conveyor belts (9, 11) and ensuring the fibres pass from the first conveyor belt to the second conveyor belt, and the apparatus further including a water-jet consolidation cylinder (12) adjacent to the upper side of the second endless conveyor belt (11), wherein the apparatus is operated at the following speed ratios:

a ratio of a circumferential speed of the at least one doffer (3, 4) to a circumferential speed of the transfer cylinder (2) is between 0.10 and 0.20;

a ratio of a circumferential speed of the at least one condenser (5, 6) to the circumferential speed of the at least one doffer (3, 4) is between 0.35 and 0.55;

a ratio of a circumferential speed of the at least one stripper roll (7, 8) to the circumferential speed of the at least one condenser (5, 6) is between 1.50 and 1.75;

a ratio of a speed of the first endless conveyor belt (9) to the circumferential speed of the at least one stripper roll (7, 8) is between 0.95 and 1.10;

a ratio of a circumferential speed of the suction drum (10) to the speed of the first endless conveyor belt (9) is between 0.70 and 0.90;

a ratio of a circumferential speed of the water-jet consolidation cylinder (12) to a speed of the second endless conveyor belt (11) is between 0.75 and 1.05; and a ratio of a speed of the second endless conveyor belt (11) to the circumferential speed of the suction drum (10) is between 0.70 and 0.90, wherein there is a distance between the at least one water-jet consolidation cylinder (12) and the second endless conveyor belt (11) of between 2 and 15 millimeters (mm).

2. The method according to claim 1, characterised in that a diameter of the transfer cylinder (2) is less than a diameter of the card drum (1).

3. The method according to claim 1, characterised in that a ratio of the second circumferential rotational speed to the first circumferential rotational speed is greater than or equal to 1.3.

4. A method for producing a light-weight nonwoven in a drylaid process in which fibres travel in a travelling direction, the method comprising:

providing fibers to an apparatus comprising a card drum (1) that is rotatable in a first direction of rotation and at a first circumferential rotational speed by a first driving means, to thereby produce a fibre web in the process, wherein the apparatus further comprises, immediately downstream of the card drum (1) in the direction in which the fibres travel in the apparatus, a transfer cylinder (2) that is rotatable in a second direction of rotation, opposite to the first direction of rotation, and at a second circumferential rotational speed by a second rotation means, the second circumferential rotational speed being greater than the first circumferential rotational speed, the transfer cylinder (2) having, on a periphery, a covering (G) comprising a plurality of teeth (16) that are angled with respect to a radius of the transfer cylinder (2) and are oriented in the second direction of rotation, and, the apparatus further comprising immediately downstream of the transfer cylinder (2), a system that comprises, immediately sequentially in a travelling direction, at least one doffer (3, 4), at least one condenser (5, 6), at least one stripper roll (7, 8), a first endless conveyor belt (9) with an upper side, a suction drum (10), and a second endless conveyor belt (11) with an upper side, the suction drum (10) being adjacent to the upper side of each of the first and second conveyor belts (9, 11) and ensuring the fibres pass from the first conveyor belt to the second conveyor belt, wherein the second conveyor belt passes the fibres to a water-jet consolidation apparatus comprising at least one water-jet consolidation cylinder (12) adjacent to the upper side of the second endless conveyor belt (11) to form a consolidated nonwoven;

wherein the apparatus is operated at the following speed ratios:

a ratio of a circumferential speed of the at least one doffer (3, 4) to a circumferential speed of the transfer cylinder (2) is between 0.10 and 0.20;

a ratio of a circumferential speed of the at least one condenser (5, 6) to the circumferential speed of the at least one doffer (3, 4) is between 0.35 and 0.55;

a ratio of a circumferential speed of the at least one stripper roll (7, 8) to the circumferential speed of the at least one condenser (5, 6) is between 1.50 and 1.75;

a ratio of a speed of the first endless conveyor belt (9) to the circumferential speed of the at least one stripper roll (7, 8) is between 0.95 and 1.10;

a ratio of a circumferential speed of the suction drum (10) to the speed of the first endless conveyor belt (9) is between 0.70 and 0.90;

a ratio of a speed of the second endless conveyor belt (11) to the circumferential speed of the suction drum (10) is between 0.70 and 0.90; and a ratio of a circumferential speed of the water-jet consolidation cylinder (12) to a speed of the second endless conveyor belt (11) is between 0.75 and 1.05;

transferring the consolidated nonwoven to a suction belt that is connected to a vacuum generator; and drying the consolidated nonwoven in a through-air dryer to form a light-weight nonwoven having a weight between 45 and 80 g/m$^2$, wherein there is a distance between the at least one water-jet consolidation cylinder (12) and the second endless conveyor belt (11) of between 2 and 15 millimeters (mm).

5. The method of claim 4, characterised in that the light-weight nonwoven may be characterised by a strength in a machine direction and a strength in a cross direction, and a ratio of the strength in the machine direction to the strength in the cross direction is from 1.0 to 1.5.

6. The method of claim 4, characterised in that the light-weight nonwoven may be characterised by an elongation in a machine direction between 35 and 70%, and an elongation in a cross direction between 70 and 130%.

7. The method of claim 4, characterised in that the fibers are made of viscose, lyocell, polyester or polypropylene.

8. The method of claim 4, characterised in that the fibers have a titre between 1.3 and 2.2 dtex, and a length between 30 and 50 mm.

* * * * *